US005923120A

United States Patent [19]

Suzuki et al.

[11] Patent Number: 5,923,120

[45] **Date of Patent: *Jul. 13, 1999**

[54] MICROCHANNEL PLATE WITH A TRANSPARENT CONDUCTIVE FILM ON AN ELECTRON INPUT SURFACE OF A DYNODE

[75] Inventors: Hideki Suzuki; Kuniyoshi Yamauchi; Atsushi Onoda; Masahiko Iguchi, all of Hamamatsu, Japan

[73] Assignee: Hamamatsu Photonics K.K., Shizuoka-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/614,000

[22] Filed: Mar. 11, 1996

[30] Foreign Application Priority Data

Mar. 10, 1995 [JP] Japan ..... P7-050924

[51] Int. Cl.[6] ..... H01J 43/04

[52] U.S. Cl. ..... 313/532; 313/535; 313/103 R; 313/103 CM; 313/105 CM

[58] Field of Search ..... 313/532, 533, 313/534, 535, 103 R, 103 CM, 105 CM

[56] References Cited

U.S. PATENT DOCUMENTS

| | | | |
|---|---|---|---|
| 3,387,137 | 6/1968 | Adams . | |
| 3,660,668 | 5/1972 | Wolski | 250/213 VT |
| 3,772,562 | 11/1973 | Goodrich | 315/10 |
| 3,777,201 | 12/1973 | Einstein | 313/65 R |

FOREIGN PATENT DOCUMENTS

| | | | |
|---|---|---|---|
| 0619596 | 10/1994 | European Pat. Off. | H01J 43/24 |
| 63-29781 | 6/1988 | Japan | H01J 31/50 |
| 233840 | 2/1990 | Japan | H01J 31/50 |
| 6295690 | 10/1994 | Japan | H01J 31/50 |
| 1589874 | 5/1981 | United Kingdom | H01J 43/28 |
| WO 89/09484 | 10/1989 | WIPO . | |

OTHER PUBLICATIONS

Military Specification; "Image Intensifier Assembly, 18 Millimeter Microchannel Wafer MX–9916/UV"; MIL–I–49052D Amendment 1; Sep. 1, 1981.

H K Pulker: "Coatings on Glass", 1984, Elsevier, Amsterdam XP002006014, pp. 441–444.

Thin Solid Films, vol. 102, 1983, Netherlands, pp. 1–46, XP000573894, KL Chopra et al: "Transparent Conductors—A Status Review".

*Primary Examiner*—Sandra L. O'Shea
*Assistant Examiner*—Vip Patel
*Attorney, Agent, or Firm*—Sughrue, Mion, Zinn, Macpeak & Seas, PLLC

[57] ABSTRACT

In the microchannel 50, a conductive film 52 is formed on an electron input surface of a dynode 51 where the plurality of channels are arranged. The conductive film is made of material that can transmit light that has originated photoelectrons and that has a refractive index lower than that of the dynode constituting material.

40 Claims, 11 Drawing Sheets

FIG. 1 (a) PRIOR ART
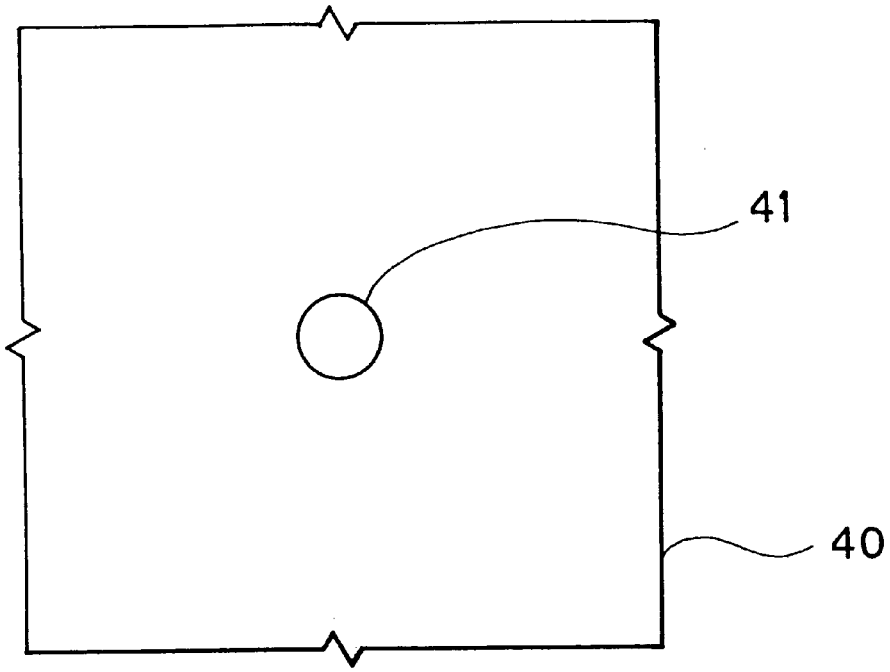
FIG. 1 (b) PRIOR ART
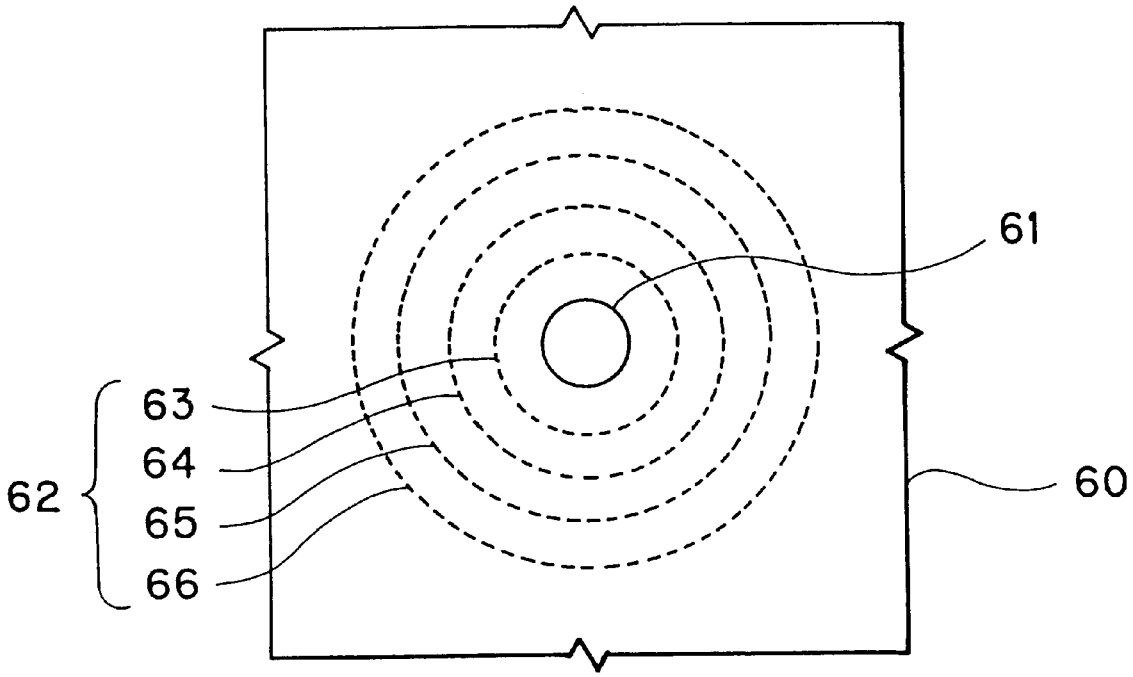

MICROCHANNEL PLATE WITH A TRANSPARENT CONDUCTIVE FILM ON AN ELECTRON INPUT SURFACE OF A DYNODE

BACKGROUND OF THE INVENTION

1. Field of the Invention

The present invention relates to a microchannel plate and a photomultiplier tube, such as an image intensifier.

2. Description of the Related Art

An image intensifier is for intensifying an extremely weak optical image several ten thousands of times to enable observation of the optical image. The image intensifier is used for two-dimensional measurement of extremely weak light, such as a nightvision.

This apparatus is produced under the assumption that it will be used under conditions with extremely weak light. Under stronger light, problems such as halo and flare develop. Halo is a phenomenon wherein a bright circular ring-shaped area appears around a strong spot of light. Flare is a phenomenon wherein dark areas around the strong light spot appear bright.

Now, halo will be described in greater detail with reference to FIGS. 1(*a*) and 1(*b*). When a bright light spot 41 enters a photocathode 40 of the image intensifier, an intensified light spot 61 is produced on a fluorescent screen 60. A circular area, or halo 62, around the light spot 61 also appears bright on the fluorescent screen. The halo 62 includes four concentric halo components 63, 64, 65, and 66 with differing luminance. FIG. 2 shows an example of luminous distribution. When the light spot 61 has a diameter of about 0.15 mm, the circular halo 62 will appear with a diameter of about 1.0 mm. When the luminance of the spot 61 is about 200 nit, the luminance of the halo 62 will be 2 nit or less. Thus, the luminance of the halo 62 is 1/100 or less the luminance of the spot 61.

A weak light spot 61 will result in only a weak halo 62 so that no problems arise. However, a relatively strong light spot 61 will produce a strong halo. Dark places around the spot, where no light is incident, conspicuously brighten, thereby lowering the picture quality. This is a characteristic of image intensifiers, which needs improvement.

Details of the halo are described in the paper "MIL-I-49052D 3.6.9, 4.6.9."

Japanese Patent Publication Kokoku No. 63-29781 describes a method for electrically suppressing halo. According to this method, a current of electrons entering the fluorescent screen is detected. Voltages, applied to a microchannel plate, are feed-back controlled so that the electron current does not exceed a certain value. This can suppress generation of surplus electrons on the microchannel plate and therefore can suppress the halo.

Japanese Patent Publication Kokai No. 2-33840 has analyzed the halo phenomenon as described below. In image intensifiers, photoelectrons of light spots photoelectrically converted in the photocathode are accelerated and multiplied in a microchannel plate. The multiplied electrons are then accelerated in an acceleration electric field developed between the microchannel plate and the fluorescent screen. The electrons then strike the fluorescent screen, which then emits fluorescence. At this time, some electrons scatter off an aluminum metal backing on the fluorescent screen and reflect back toward the microchannel plate. The reflected electrons reenter the acceleration electric field which pushes them into the fluorescent screen. The fluorescent screen emits fluorescence as a result. Thus reflected and then reentered electrons generate the halo light.

Based on the above-described analysis of the halo generation, document No.2-33840 has proposed one method for suppressing the reflected electrons. According to this method, light element such as carbon is deposited on the metal backing on the fluorescent screen.

SUMMARY OF THE INVENTION

U.S. Pat. No. 5,510,588 proposes still another method for suppressing halo. According to this method, a strip resistance of the microchannel plate is set within a certain range. This permits automatically gain-controlling the microchannel plate so that current of electrons entering the fluorescent screen does not exceed a certain amount. It is therefore possible to suppress generation of surplus electrons on the microchannel plate and is therefore possible to suppress halo.

The above-described several proposals, however, only partially succeed in suppressing halo.

It is therefore, an object of the present invention to overcome the above-described drawbacks, and to provide an improved microchannel plate and a photomultiplier tube, such as an image intensifier, which can fully suppress halo and flare and therefore which can provide a highly qualified detection.

In order to attain the above and other objects, the present inventors have conducted further research on the image intensifiers. The present inventors have noticed that a portion of light incident on the photocathode passes through the photocathode and falls incident on an electron input side of the microchannel plate. In the microchannel plate, channels are formed at regular intervals. A metal electrode layer, such as an Inconel film, is formed over the electron input side so as to cover the edges of the channels and the areas surrounding those edges. The light greatly scatters off the metal electrode layer, and reflects back to the photocathode, whereupon the photocathode emits photoelectrons. These electrons will also contribute to production of the halo.

Based on this acknowledgement, the present invention provides a microchannel plate for multiplying incident electrons, the microchannel plate comprising: a dynode with an electron incident surface and an electron output surface opposed to the electron incident surface, the dynode being formed with a plurality of channels arranged to extend between the first surface and the second surface; an output side electrode layer provided on the electron output surface of the dynode; and an input side electrode layer provided on the electron input surface of the dynode, an electric voltage being applied between the output side electrode layer and the input side electrode layer to generate an electric field in each of the plurality of channels, the input side electrode layer being formed of a conductive material which is capable of transmitting a light incident to the output side electrode layer.

According to another aspect, the present invention provides a photomultiplier tube, comprising: a photocathode for receiving light and for emitting photoelectrons accordingly; a microchannel plate for receiving the photoelectrons and for multiplying the photoelectrons, the microchannel plate having a dynode with an electron incident surface and an electron output surface opposed to the electron incident surface, the dynode being formed with a plurality of channels arranged to extend between the electron incident surface and the electron output surface, the microchannel plate being located with the electron incident surface confronting the photocathode, an output side electrode layer being provided on the electron output surface of the dynode, and an input side electrode layer being provided on the electron input surface of the dynode, the input side electrode layer being formed of conductive material capable of transmitting the light, an electric voltage being applied between the output side electrode layer and the input side electrode layer to generate an electric field in each of the plurality of channels; and an anode located in confrontation with the electron output surface of the microchannel plate for receiving the multiplied photoelectrons from the microchannel plate.

According to a further aspect, the present invention provides an image intensifier apparatus, comprising: a photocathode for converting a light bearing a first optical image to corresponding photoelectrons; a microchannel plate for multiplying the photoelectrons, the microchannel plate having a dynode with an electron incident surface and an electron output surface opposed to the electron incident surface, the dynode being formed with a plurality of channels arranged to extend between the electron incident surface and the electron output surface, the microchannel plate being located with the electron incident surface confronting the photocathode, an output side electrode layer being provided on the electron output surface of the dynode, and an input side electrode layer being provided on the electron input surface of the dynode, the input side electrode layer being made of conductive material capable of transmitting the light, an electric voltage being applied between the output side electrode layer and the input side electrode layer to generate an electric field in each of the plurality of channels; a fluorescent screen for converting the photoelectrons multiplied in the microchannel plate to a light bearing an intensified first optical image, the fluorescent screen emitting the optical image.

The dynode may preferably be made of a material which is capable of absorbing the light having passed through the input side electrode layer. The conductive material of the input side electrode layer may be transparent, and the dynode may be opaque at least in a portion of the dynode.

The input side electrode layer provided on the electron incident surface of the microchannel plate may preferably be made of an ITO film or a NESA film. The dynode of the microchannel plate may preferably be made of a deoxidized lead glass.

BRIEF DESCRIPTION OF THE DRAWINGS

The above and other objects, features and advantages of the invention will become more apparent from reading the following description of the preferred embodiment taken in connection with the accompanying drawings in which:

FIG. 1(*a*) is a schematical plan view of a light spot incident on a photocathode in a conventional image intensifier;

FIG. 1(*b*) is a schematic plan view of a light spot and its accompanying halo appearing on a fluorescent screen due to the light spot of FIG. 1(*a*);

FIG. 4(*b*) shows a surface condition of a fluorescent screen in the photomultiplier tube of the embodiment;

FIG. 5(*b*) is an enlarged sectional view of the microchannel plate of FIG. 5(*a*) and shows how light proceeds between a photocathode and the microchannel plate in the photomultiplier tube;

FIG. 9(*b*) is a graph showing luminance distribution of the light spot and the halo light.

DETAILED DESCRIPTION OF THE PREFERRED EMBODIMENT

Figure 2:
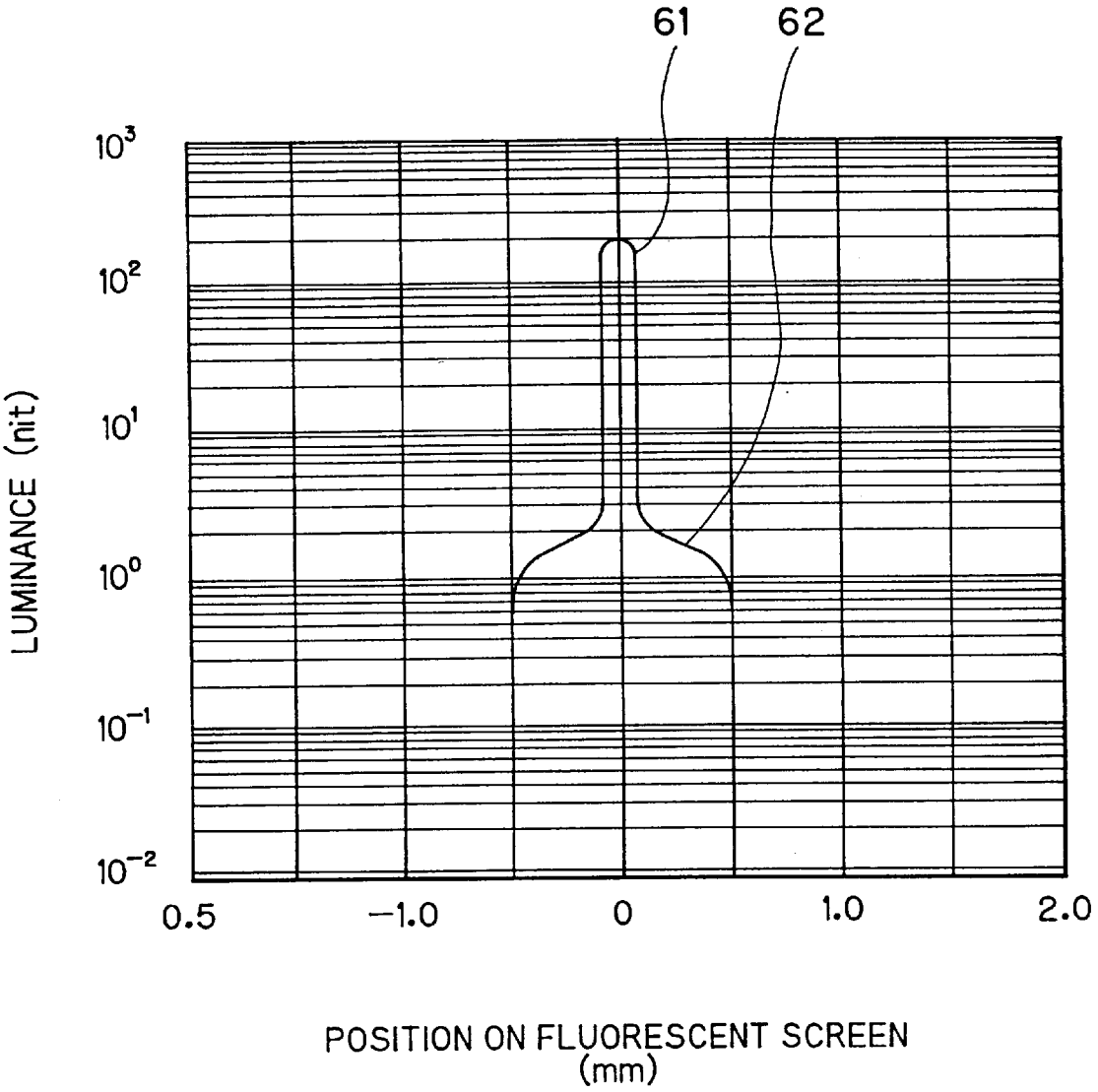
FIG. 2 PRIOR ART
FIG. 2 is a graph showing luminance distribution of the light spot and the halo of FIG. 1(*b*)

A photomultiplier tube according to a preferred embodiment of the present invention will be described while referring to the accompanying drawings wherein like parts and components are designated by the same reference numerals.

First, a mechanism of the photomultiplier tube of the present embodiment will be described with reference to FIGS. 4(*a*)–5(*b*).

Figure 4:
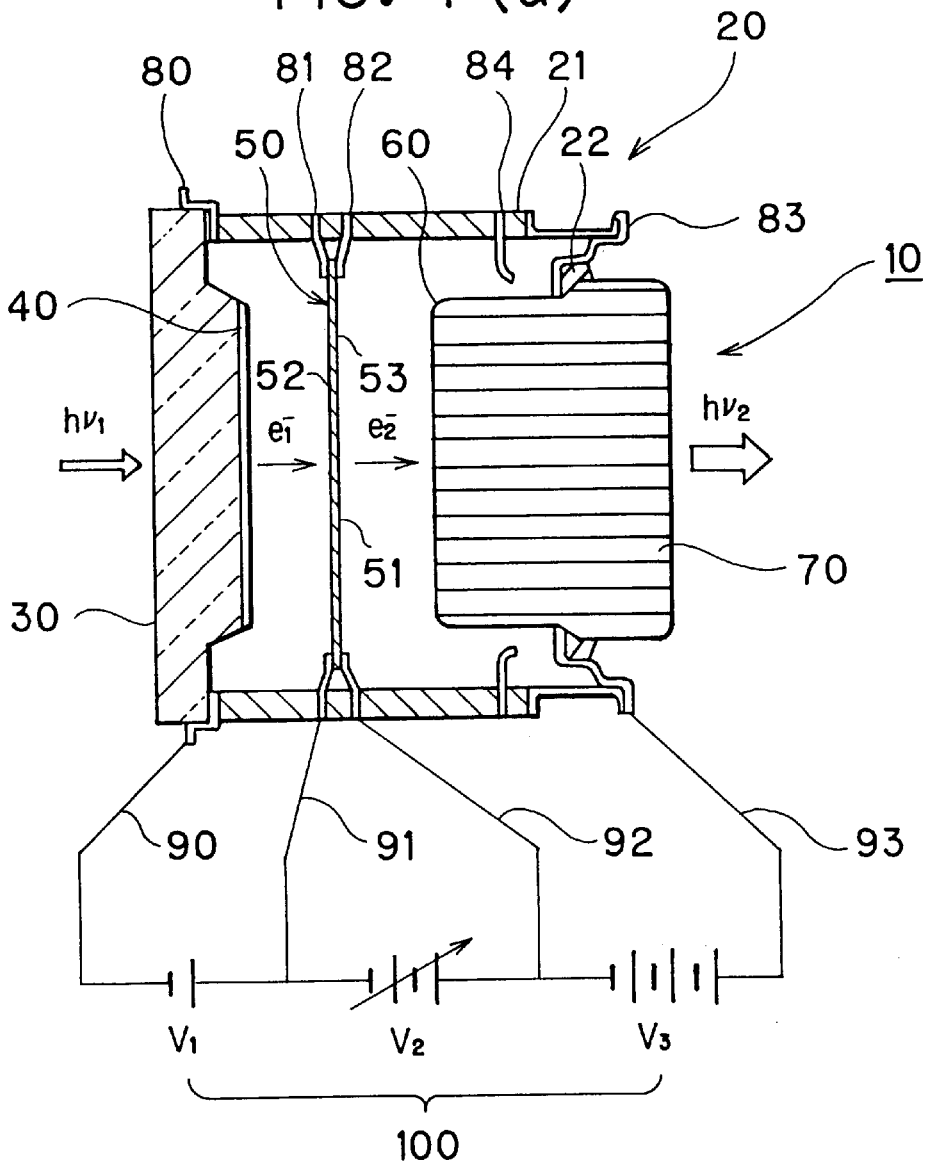
FIG. 4(*a*) is a schematical sectional view of a photomultiplier tube of the embodiment of the present invention.
Figure 4:
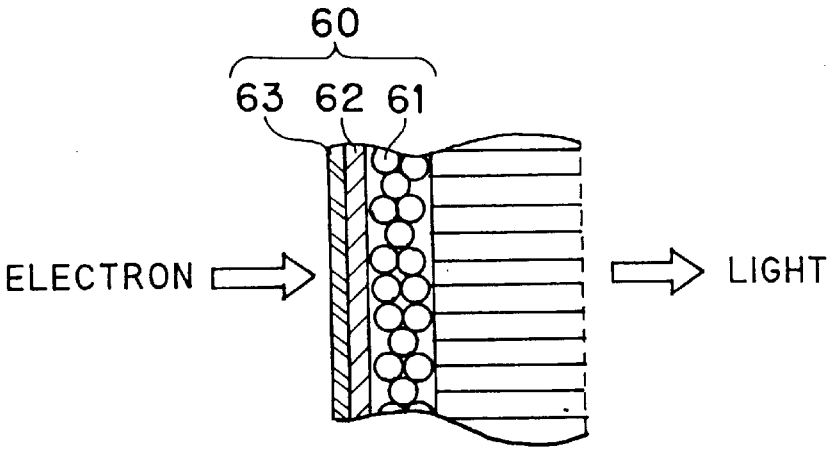

FIG. 4(*a*) shows a schematic structure of the photomultiplier tube 10. This apparatus is a proximity image intensifier 10 which mainly includes: a photocathode 40; a microchannel plate (which will be simply referred to as MCP hereinafter) 50; and a fluorescent screen 60. All these elements are enclosed in a vacuum tubular envelope 20. An input 30 and an output 70 are fitted to both ends of the tubular envelope 20.

The photocathode 40 is placed at an inner surface on the input 30. The photocathode 40 is for converting light, which passes through the input 30 and falls incident on the photocathode 40, to a number of photoelectrons corresponding to brightness of the incident light.

The MCP 50 is disposed in confrontation with the photocathode 40. An electric voltage V1 is developed between the photocathode 40 and the MCP 50 to accelerate photoelectrons emitted from the photocathode 40 toward the MCP 50. The MCP 50 is constructed from a dynode 51 formed with a plurality of channel electron multipliers 54. The dynode 51 has an electron input surface confronting the photocathode 40 and an electron output surface opposed to the electron input surface. The channels 54 extend between the opposite surfaces so as to be opened on those surfaces.

Figure 5:
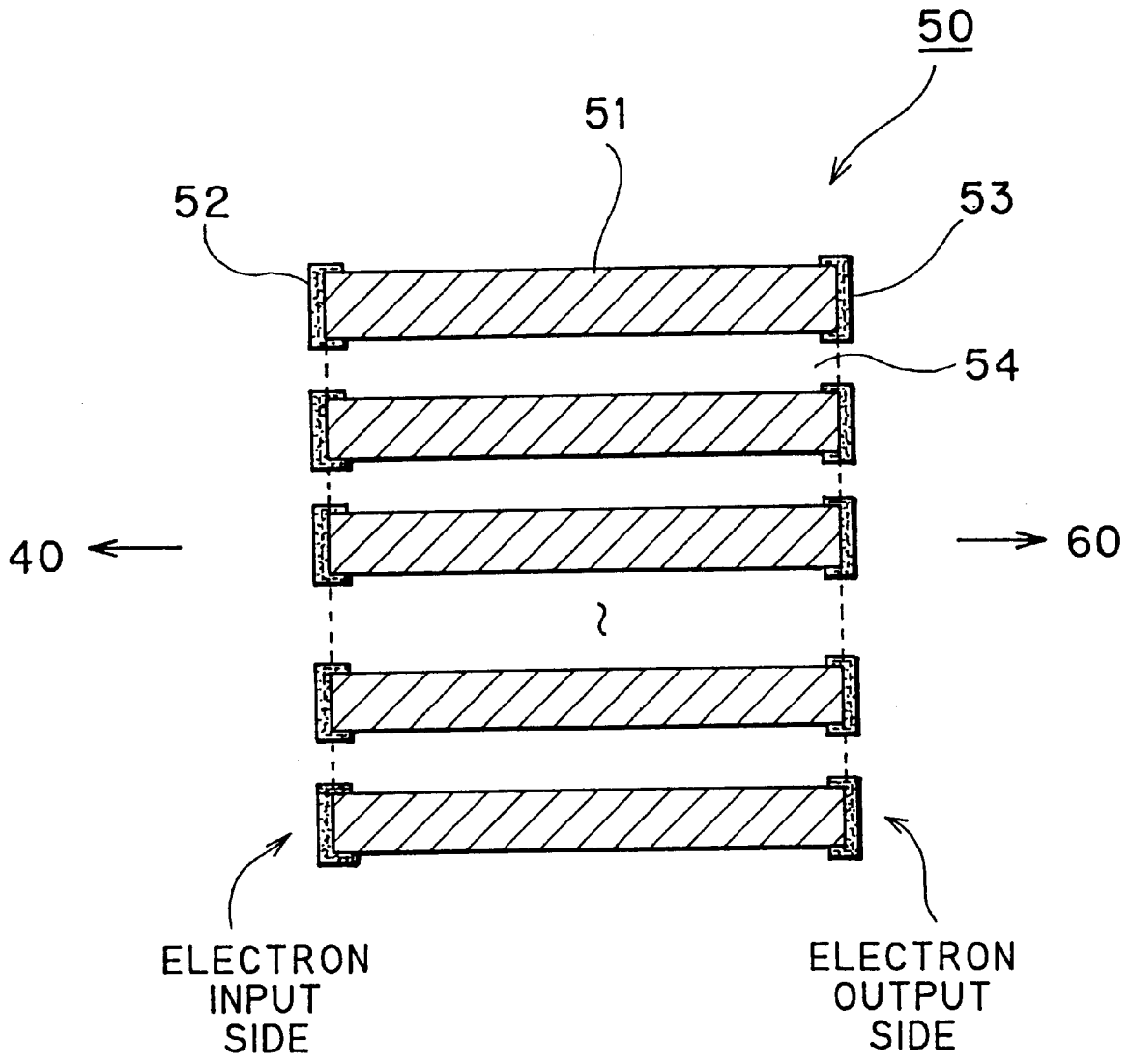
FIG. 5(*a*) is a schematical sectional view of a microchannel plate employed in the photomultiplier tube of the embodiment.
Figure 5:
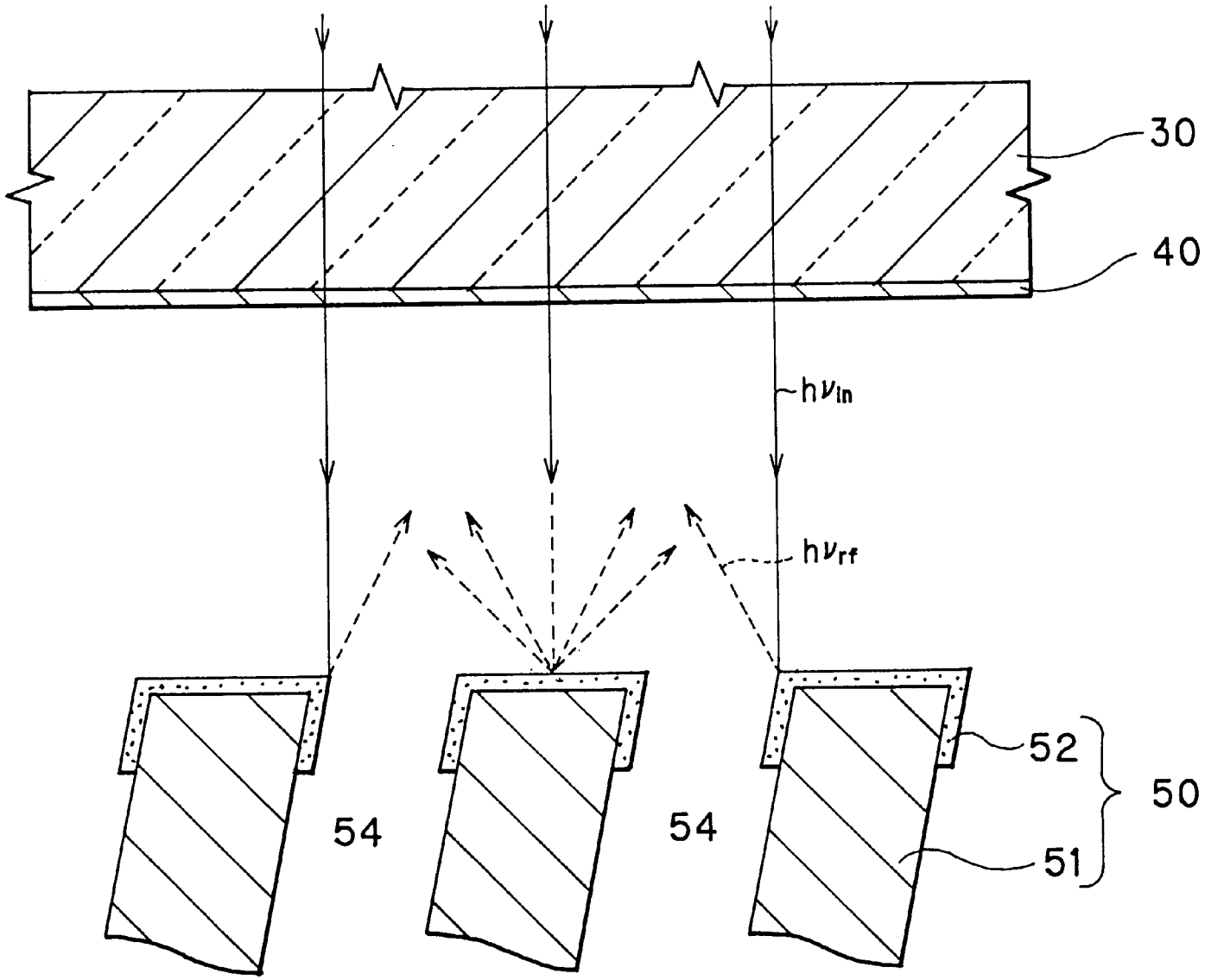

As shown in FIG. 5(*a*), an input electrode layer 52 is formed on the electron input surface of the dynode 51 so as to cover the edges of the channels 54 and the areas surrounding those edges. Similarly, an output electrode layer 53 is formed on the electron output surface of the dynode 51 so as to cover the edges of the channels 54 and the areas surrounding those edges.

An electric voltage V2 is developed between the input and output electrode layers 52 and 53, so that an acceleration electric field is generated in each channel 54 to accelerate the photoelectrons in the direction from the layer 52 toward the layer 53. A photoelectron that reaches the input side of a channel 54 is accelerated in accordance with the electric field generated inside the channel 54. The electron moves in the channel 54 while repeatedly colliding with the inner wall of the channel. Every time the electron collides with the inner wall, the electron loses a fixed amount of energy (i.e., an energy of about 3.6 eV), whereupon a pair of an electron and a hole is produced. The electron in the electron-hole pair serves as a secondary electron. While the electron repeatedly collides with the inner wall, a electron-hole pair is repeatedly produced. Thus, electrons are multiplied with a gain corresponding to the voltage applied between the layers 52 and 53, before exiting from the output side of the channel 54.

According to the present embodiment, the input electrode layer 52 is constructed from a conductive film capable of transmitting the light originally incident on the photocathode 40. In other words, the input electrode layer 52 is transparent at least with regards to the original light. The dynode 51 is made of a material which is capable of absorbing the light having passed through the electrode layer 52. In more concrete terms, the dynode 51 is made opaque at least in its portion.

Especially, according to the present embodiment, the refractive index of the conductive film 52 is lower than that of the dynode 51 with regards to the original light. Accordingly, the refractive indices of the vacuum space, the electrode layer 52, and the dynode 51 satisfy the following condition:

$n<n0<n1$ where n is the refractive index of the vacuum space, n0 is the refractive index of the electrode layer 52, and n1 is the refractive index of the dynode 51. With this arrangement, the electrode layer 52 can serve as an antireflection film. That is, the antireflection effect of the electrode layer 52 can be easily controlled through properly setting the relationship among the wavelength of the original light, the thickness of the electrode layer 52, and the refractive indices of the electrode layer 52 and the diode 51.

Assume now that the original light $h\nu_{in}$ passes through the photocathode 40 and reaches the MCP 50 as shown in FIG. 5(*b*). Reaching the exposed surface of the input electrode layer 52, a large part of the light enters the electrode layer 52, while a remaining small part reflecting off the surface. The light entering the electrode layer 52 passes through the electrode layer 52. A large part of that light then enters the dynode 51, where the light is absorbed. A remaining small part of that light, that reflects off the interface between the electrode layer 52 and the dynode 51, is subjected to a destructive interference with the light reflected off from the exposed surface of the electrode layer 52, i.e., the interface between the vacuum space and the electrode layer 52. Accordingly, light of only a very small intensity will return to the photocathode 40 so that halo and flare are greatly suppressed.

According to a preferable combination of the input electrode layer 52 and the dynode 51, the layer 52 is made of an indium-tin-oxide (ITO) film made of $In_2O_3$ and $SnO_2$ or a NESA film (i.e., a tin oxide ($SnO_2$) film), and the dynode 51 is made of a deoxidized lead glass. The layer 52 is formed on the dynode 51 through deposition.

The deoxidized lead glass can be produced in the following procedure. Transparent lead glass is first processed or molded into a desired disk shape with the plurality of hollow channels. A thus-formed lead glass plate is placed inside of a vacuum furnace. The lead glass plate is deoxidized from its surface to its inside by an inflow of hydrogen gas under high temperature. As the deoxidization proceeds, a lead metal precipitates on the entire surfaces of the lead glass plate to form a resistance layer. The resistance layer is black and has a low light reflectivity. The resistance layer also has a high refractive index due to the metal lead in the resistance layer.

The transparent electrode layer 52 is formed on one side surface of the plate where the resistance layer is formed. With this arrangement, light passing through the transparent electrode layer 52 is absorbed in the black-colored resistance layer. Additionally, at least in the vicinity of the interface between the layer 52 and the dynode 51, the refractive index of the layer 52 becomes lower than that of the dynode 51. Accordingly, the layer 52 can properly serve as the antireflection layer.

It is noted that the refractive index of the dynode 51 at the interface with the layer 52 can be freely set through controlling the growth of the resistance layer with parameters, such as an atmosphere temperature, a hydrogen gas concentration, a deoxidation time and so on. It is further noted that in the same manner, the strip resistance of the MCP 50 is preferably set within the range of $1\times10^8$ ohms and $1\times10^{10}$ ohms, whereby halo can be further suppressed as described in U.S. Pat. No. 5,510,588, the disclosure of which is hereby incorporated by reference.

The material of the output electrode layer 53 can be freely selected from various conductive materials. The layer 53 can be produced from an Inconel film. Or otherwise, the layer 53 can be produced from an ITO film or an NESA film.

The fluorescent screen 60 is disposed at an inner surface on the output 70. The fluorescent screen 60 is for emitting fluorescence by bombardment of electrons multiplied by the MCP 50. As shown in FIG. 4(*b*), the fluorescent screen 60 is constructed from a fluorescent substance 61 coated on the output 70 and an aluminum metal backing 62 deposited on the fluorescent substance 61. A low electron-reflection layer 63 of carbon, beryllium, or the like is further deposited on the backing 62. The metal back 62 has a relatively high reflectivity in regards to light entering through the MCP 50. The metal back 62 has also a relatively high transmittance in regards to photoelectrons emitted from the MCP 50. The low electron-reflection layer 63 has a relatively low reflectivity in regards to the photoelectrons emitted from the MCP 50. The layer 63 is for suppressing reflection of electrons on the fluorescent screen 60 and suppresses halo accordingly.

An electric voltage V3 is applied between the MCP 50 and the fluorescent screen 60 for accelerating the photoelectrons from the MCP 50 toward the fluorescent screen 60.

The fluorescent screen 60 is fiber-coupled with optical fibers constituting the output 70. The output 70 can be connected with a CCD or other devices.

In the image intensifier 10 having the above-described structure, the voltages V1, V2, and V3 develop electric fields respectively in the gap between the photocathode 40 and the MCP 50, in the insides of the channels 54 between the layers 52 and 53, and in the gap between the MCP 50 and the fluorescent screen 60. These electric fields accelerate electrons in a direction from the photocathode 40 toward the fluorescent screen 60.

When a low intense first optical image $h\nu_1$ enters the input 30 from outside and falls incident on the photocathode 40, electrons in a valenced band in the photocathode 40 are excited into a conduction band. Those electrons (photoelectrons) $e^-_1$ are emitted from the conduction band into the vacuum space. As a result, an electronic image $e^-_1$ corresponding to the first optical image $h\nu_1$ is obtained. Thus, the photocathode 40 converts light into photoelectrons while maintaining the two-dimensional information borne on the original light.

The photoelectrons $e^-_1$ are accelerated toward the input side of the MCP 50, and enters the channels 54. In the channels 54, the photoelectrons are multiplied with a gain in the range of about $1\times10^3$ and $2\times10^4$ in accordance with the voltage $V_2$ applied between the electrode layers 52 and 54. Electrons $e^-_2$ multiplied in this manner are outputted from the MCP 50, thereby forming an intensified electronic image $e^-_2$ corresponding to the first optical image $h\nu_1$. Thus, the MCP 50 intensifies the electronic image while maintaining the two-dimensional information borne on the original electrons.

The photoelectrons $e^-_2$ thus emitted from the MCP 50 are accelerated toward the fluorescent screen 60 in accordance with the electric field. The fluorescent screen 60 emits fluorescence $h\nu_2$ when struck by the photoelectrons $e^-_2$. The fluorescence $h\nu_2$ is emitted outside through the output 70. A second optical image $h\nu_2$ corresponding to the first optical image $h\nu_1$ is thus outputted from the output 70. Thus, the photomultiplier tube 10 intensifies the first optical image $h\nu_1$ while maintaining the two-dimensional information borne on the first optical image.

As mentioned above, a portion of light $h\nu_1$ passes through the photocathode 40. The light $h\nu_1$ reaches the electron input side of the MCP 50. That is, the light reaches the electrode layer 52 which covers the edges of the channels 54 and the areas surrounding the edges. According to the present invention, the conductive film 52 is made of material that can transmit light $h\nu_{in}$ which is inputtable to the image intensifier 10, that is, which is inputtable to the film 52 through the input 30 and the photocathode 40. The dynode 51 has certain absorption characteristics capable of absorbing the light $h\nu_{in}$.

The material of the conductive film 52 has a certain refractive index in regards to that light $h\nu_{in}$. The material constituting the dynode 51 has another refractive index in regards to that light $h\nu_{in}$. The refractive index of the dynode 51 is higher than that of the conductive film 52. Accordingly, the conductive film 52 also serves as an antireflection film.

Thus, only a small amount of light $h\nu_{rf}$ will scatter and return to the photocathode 40 because of the transmissivity of the conductive film 52, of the light absorption characteristics of the dynode 51, and of the refractive indices of the film 52 and the dynode 51. It is therefore possible to suppress halo and flare produced by light reflecting back to the photocathode 40.

Next, a concrete example of the image intensifier 10 will be described with reference to FIG. 3.

The tubular envelope 20 is constructed from: an inner tube 21; a mold 22 covering the inner tube 21; and an outer casing 23 covering the mold 22. The mold 22 has a substantially tubular shape with a small opening at both its input and output ends. The outer casing 23 has a substantially tubular shape with a large opening at its input end and a small opening at its output end. The outer casing 23 covers the peripheral side and the output end of the mold 22. The small openings formed at the output ends of both the mold 22 and the casing 23 have the same size and contour.

Both ends of the envelope 20 are air-tightly sealed by the input 30 and the output 70. That is, a substantially disk-shaped input 30 is provided inside the tubular mold 22. The outer planar surface of the input 30 is in abutment contact with the inner surface of the mold 22 near the input end opening of the mold 22. A substantially cylindrical output 70 is provided fitted in the output end openings of the mold 22 and the casing 23.

In order to produce the envelope 20 having the above-described structure, plastic material is first processed into the inner tube 21. Then, the mold 22 is formed by molding silicone rubber around the input 30, the inner tube 21, and the output 70 which are located in the relative positions shown in FIG. 3. Plastic material is again processed into a shape conforming with the outer shape of the mold 21, so that the outer casing 23 is obtained. The interior of the envelope 20 is maintained at a high vacuum, i.e., in the range of about $1\times10^{-8}$ to about $1\times10^{-6}$ Torr.

The input 30 is a substantially disk-shaped plate made of quartz glass. The input 30 has an inner vacuum side and an outer atmospheric side. The central area at both sides is substantially planar. A film-shaped photocathode 40 is provided to the central area on the inner vacuum side. The photocathode 40 is made from an alkali metal deposited on the inner side surface of the input 30. For example, the photocathode 40 is constructed from a molecular film of potassium, sodium, or the like. When the photocathode 40 is for emitting photoelectrons upon receiving light of a predetermined wavelength, the input 30 is be made of a glass plate capable of transmitting light of the predetermined wavelength.

Although not shown in the drawings, a first metal layer is provided on the inner side surface of the input 30 around the photocathode 40 in contact therewith. A connection member 80 is provided for electrically connecting the photocathode 40 to an external power supply 100. The connection member 80 is supported between the inner tube 21 and the input 30, and is partially embedded in the peripheral part of the mold 22. One end of the connection member 80 protrudes inwardly to contact the first metal layer. The other end protrudes outwardly to contact a lead wire 90. The lead wire 90 air-tightly passes through both the mold 22 and the casing 23 to protrude outside the envelope 20. The lead wire 90 is connected to the power supply 100.

The output 70 is a fiber plate which is constructed from a bundle of a plurality of optical fibers. The output 70 is located relative to the photocathode 40 so that the constituent optical fibers are arranged with their optical axes extending normal to the photocathode 40. Both ends of the optical fibers form opposite plain surfaces: an outer atmospheric side surface and an inner vacuum side surface. The inner side surface of the fiber plate 70 is parallel to the photocathode 40.

As shown in FIG. 4(*b*), the film-shaped fluorescent screen 60, including the fluorescent substance 61 and the metal backing 62, is formed at the central area on the inner side surface of the output 70. The fluorescent substance 61 coated on the inner side surface of the output 70 is (ZnCd)S:Ag, for example. The metal backing 62 is formed on the fluorescent substance 61 through depositing aluminum over the fluorescent substance 61. The low electron-reflection layer 63 is further formed on the backing 62 through depositing carbon, beryllium, or the like over the metal backing 62.

The output 70 is made of a fiber plate comprised of a plurality of optical fibers capable of guiding the fluorescent light emitted from the fluorescent substance 61. It is noted that the output 70 can be made of a glass plate capable of transmitting the fluorescent light.

Although not shown in the drawings, a second metal layer is provided on the inner side surface of the output 70 around the fluorescent screen 60 in contact therewith. Another connection member 83 is provided for electrically connecting the fluorescent screen 60 to the external power supply 100. The connection member 83 is supported between the inner tube 21 and the mold 22, and is partially embedded in the peripheral part of the mold 22. One end of the connection member 83 protrudes inwardly to contact the second metal layer. The other end protrudes outwardly to contact a lead wire 93. The lead wire 93 air-tightly passes through both the mold 22 and the casing 23 to protrude outside the envelope 20. The lead wire 93 is connected to the power supply 100.

The disk-shaped MCP 50 is provided in the interior of the envelope 20 at a position between the photocathode 40 and the fluorescent screen 60. The input electrode layer 52 confronts the photocathode 40, while the output electrode layer 53 confronts the fluorescent screen 60. The MCP 50 is held between two connection members 81 and 82. The connection members 81 and 82 are partially embedded in the inner tube 21. One end of the connection member 81 projects inwardly to connect with the input electrode layer 52. The other end of the connection member 81 projects outwardly to connect with a lead wire 91, which air-tightly passes through both the mold 22 and the casing 23 to connect with the power supply 100. Thus, the connection member 81 serves not only to support the MCP 50, but also to connect the electrode layer 52 to the power supply 100. Similarly, one end of the connection member 82 projects inwardly to connect with the output electrode layer 53. The other end of the connection member 82 projects outwardly to connect with a lead wire 92, which air-tightly passes through both the mold 22 and the casing 23 to connect with the power supply 100. Thus, the connection member 82 serves not only to support the MCP 50 but also to connect the electrode layer 53 to the power supply 100.

The MCP 50 is located with gaps being formed between the photocathode 40 and the electrode layer 52 and between the electrode layer 53 and the fluorescent screen 60. For example, the gap between the electrode layer 52 and the photocathode 40 can be set in the range of about 0.05 mm and about 0.3 mm. The gap between the electrode layer 53 and the fluorescent screen 60 can be set in the range of about 0.2 mm and about 1.5 mm. Preferably, the gap between the electrode layer 52 and the photocathode 40 may be set in the range of about 0.1 mm and about 0.3 mm, the gap between the electrode layer 53 and the fluorescent screen 60 being in the range of about 0.5 mm and about 1.0 mm.

Another mounting member 84 is partially embedded in the inner tube 21. One end of the mounting member 84 protrudes inwardly to a position distant from the output 70 at a certain gap.

The five members 80–84 are made from metal cobal, and the four lead wires 90–93 are made from teflon wires.

As shown in FIG. 4(*a*), the power supply 100 develops a fixed electric potential difference $V_1$ of about 200 volts between the photocathode 40 and the electrode layer 52 of the microchannel plate 50. The power supply 100 develops another electric potential difference $V_2$ between the electrode layers 52 and 53 of the MCP 50. The power supply 100 can adjust the amount of the difference $V_2$ within a range of about 500 volts and about 900 volts. The power supply 100 develops still another fixed electric potential difference $V_3$ of about 6 kilovolts between the electrode layer 53 and the fluorescent screen 60.

For example, an electric potential in the range of about −150 volts and about −200 volts develops at the photocathode 40. An electric potential in the range of about −150 volts and about −200 volts develops at the electrode layer 52 of the MCP 50. An electric potential in the range of about 500 volts and about 900 volts develops at the electrode layer 53 of the MCP 50. An electric potential in the range of about 5000 volts and about 6000 volts develops at the fluorescent screen 60.

In the MCP 50, a plurality of channel multipliers 54 extend through the input electrode layer 52, the dynode 51, and the output electrode layer 53. On both the layers 52 and 53, the channel multipliers 54 are arranged at an interval in the range of about 7.5 micrometers and about 25 micrometers, the interval being defined as a distance between the centers of the channel multipliers 54.

The dynode 51 is preferably a deoxidized lead glass. In the deoxidized lead glass, a lead metal precipitates to darken the glass plate and therefore to lower the light reflectivity. The precipitating lead glass also enhances the refractive index of the dynode. The electrode layer 52 is made of a conductive material which can transmit light having passed through the input 30 and the photocathode 40. In other words, the electrode layer 52 is transparent at least in regards to the light of the predetermined wavelength which the input 30 transmits. The refractive index of the electrode layer 52 is lower than that of the dynode 51. Preferably, the electrode layer 52 is made of an ITO film or a NESA film.

In the image intensifier 10 having the above-described structure, when an optical image is formed on the photocathode 40, a number of photoelectrons corresponding to brightness of the image are emitted from the photocathode 40. The electronic image with photoelectrons is therefore formed on the input side of the MCP 50. In the MCP 50, the electrons are multiplied several thousands of times before being outputted from the output side. The electrons are accelerated toward the fluorescent screen 60. Then, the electrons fall incident on the fluorescent screen 60 to become an optical image again. The optical image is, in result, the incident light multiplied several ten thousands of times. The optical image is then outputted from the output 70 and received at a CCD or other devices. The electrode layer 52 is transparent. The dynode 51 has a low reflectivity, and can absorb the incident light. The electrode layer 52 also serves as the antireflection layer. Accordingly, only a very small amount of light scatters and reflects off the MCP 50 back to the photocathode 40.

Measurements relevant to the above-described embodiment will be described below.

First, the present inventors produced various samples of the MCP 50. Those samples include two types: a first type constructed from the lead glass dynode 51 not being deoxidized and a second type constructed from the deoxidized lead glass dynode 51. The dynodes of the first type were produced through merely polishing lead glass plates. The dynodes of the second type were produced through polishing lead glass plates and then deoxidizing the lead glass plates. The non-deoxidized lead glass dynode is transparent, while the deoxidized lead glass dynode is darkened black with the precipitating metal lead. Each type of samples include three models: a first model with its electron input surface covered with an input electrode layer 52 of an ITO film; a second model with its electron input surface covered with an input electrode layer 52 of an Inconel film; and a third model covered with no electrode layer 52. The first models of each type were produced through depositing the ITO films on the corresponding dynodes. The second models of each type were produced through depositing the Inconel films on the corresponding dynodes. The third models of each type were produced through not depositing any films over the corresponding dynodes.

The present inventors measured light reflectivity spectra of those MCP models 50.

Figure 6:
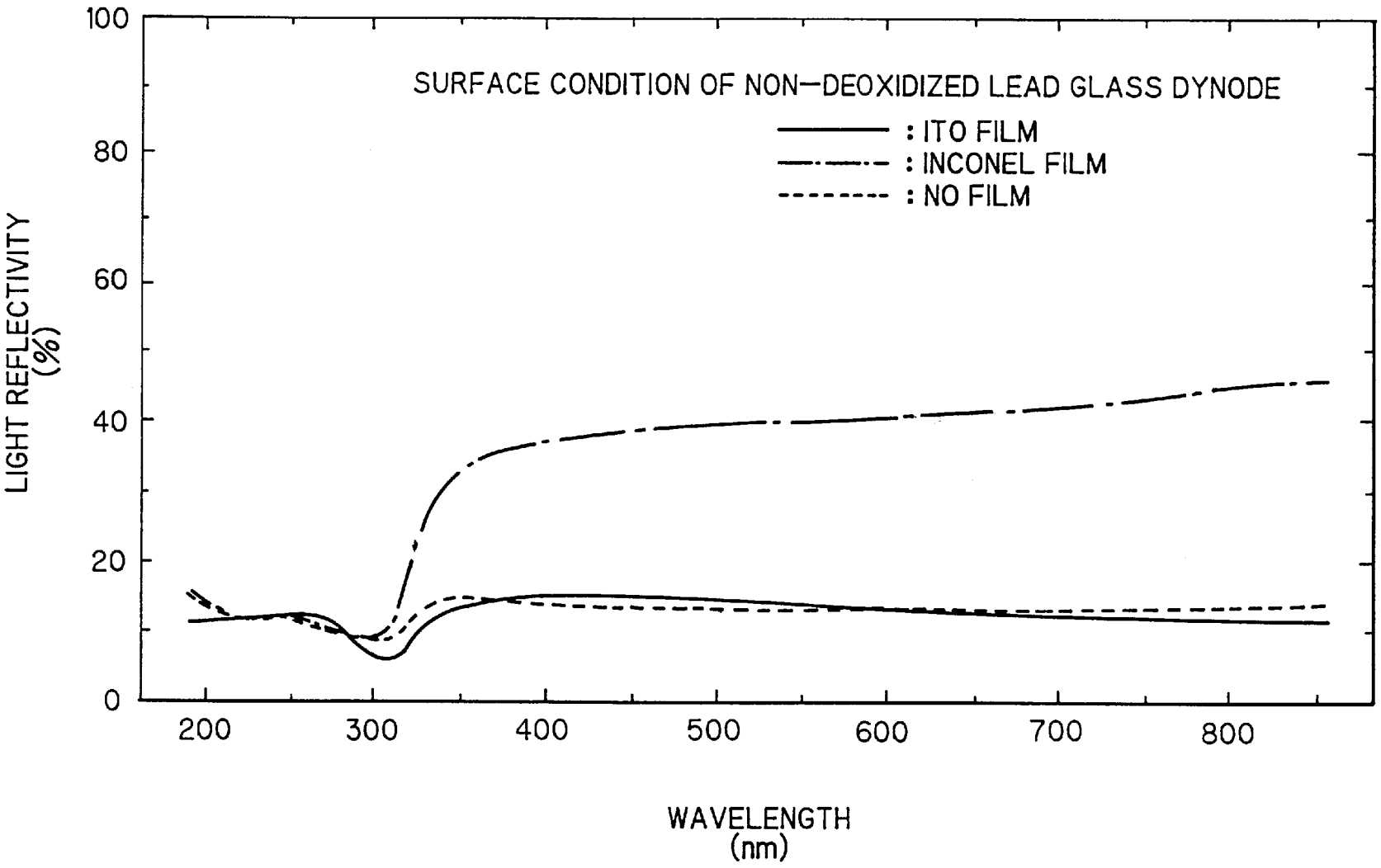
FIG. 6 is a graph showing a spectrum characteristic of a non-deoxidized lead glass dynode with various types of conductive films.
Figure 7:
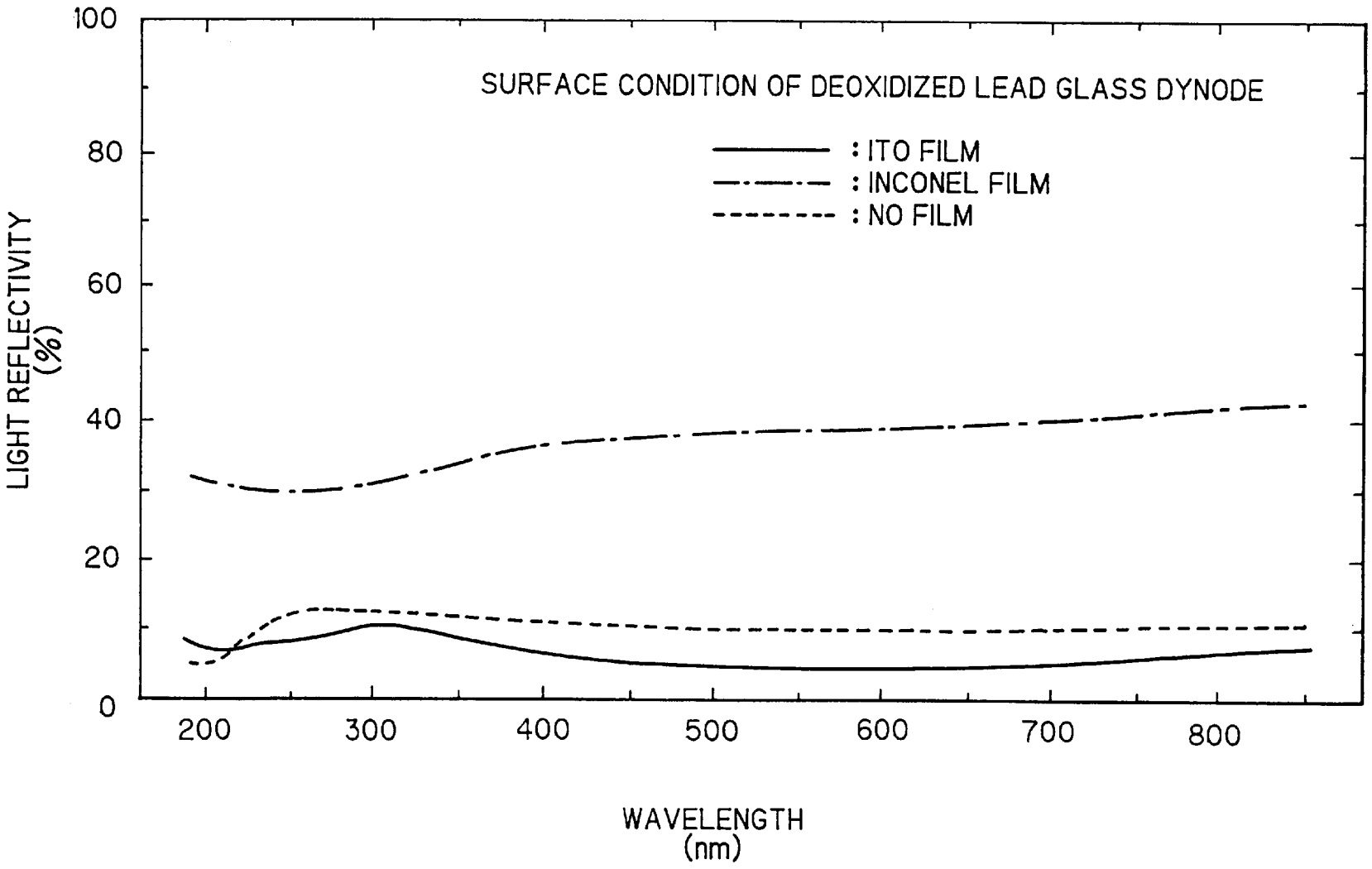
FIG. 7 is a graph showing a spectrum characteristic of the deoxidized lead glass dynode with various types of conductive films.

FIG. 6 shows the light reflectivity spectra of the three models of MCPs 50 of the first type constructed from the non-deoxidized lead glass. FIG. 7 shows the light reflectivity spectra of the three models of MCPs 50 of the second type constructed from the deoxidized lead glass. In each graph, the horizontal axis denotes wavelength of light incident on the input side of the MCP 50, and the vertical axis denotes light reflectivity at which the input side of the MCP reflects the input light. These graphs show that the deoxidized lead glass dynode with the ITO film presents the lowest reflectivity over almost all tested wavelengths. These graphs further show that the black colored deoxidized lead glass presents lower light reflectivity than does the non-deoxidized lead glass.

As apparent from these graphs, the Inconel film, which has a high metal gloss, has a higher light reflectivity than does the dynode. Accordingly, when the Inconel film is formed on the dynode, the high reflectivity of the Inconel determines the reflectivity of the MCP. Thus, the MCP with the Inconel presents the high reflectivity. On the other hand, when the transparent ITO film is formed on the dynode, the reflectivity of the MCP is determined by the reflectivity of the dynode itself. Accordingly, the reflectivity of the MCP with the ITO film becomes lower than that of the MCP with the Inconel. In addition, when the deoxidized lead glass is used as the dynode, the ITO film also serves as an antireflection film to further decrease the reflectivity of the MCP.

Next, the present inventors measured refractive indices of the deoxidized lead glass dynode and the non-deoxidized lead glass dynode.

First, the present inventors measured the refractive index of a dynode 51 made of a non-deoxidized lead glass. To measure the refractive index, the present inventors controlled an HeNe laser source to radiate a 632.8 nm wavelength laser light on the electron input surface of the dynode 51. The laser light fell incident on the dynode at an incident angle of 90°. The present inventors then measured, with a photo-diode, the intensity of the laser light reflected from the dynode 51. Using the intensity $P_{in}$ of the laser light radiated onto the dynode 51 and the intensity $P_{rf}$ of the laser light reflected from the dynode 51, the present inventors calculated a light reflectivity r of the electron input surface of the dynode 51 with the following equation (1):

$$r=P_{rf}/P_{in} \quad (1)$$

The present inventors then calculated a surface light reflectivity R of the electron input surface of the dynode 51 with the following equation (2);

$$R+R(1-R)^2=r \quad (2)$$

Finally, the present inventors calculated the refractive index n of the dynode 51 with the following equation (3):

$$n(1+R^{1/2})/(1-R^{1/2}) \quad (3)$$

The present inventors further measured a refractive index of the deoxidized lead glass dynode 51 using an ellipsometer. The present inventors used the HeNe laser source to radiate a 632.8 nm wavelength laser light onto the electron input surface of the deoxidized lead glass dynode 51. The laser light fell incident on the electron input surface of the dynode 51 at an incident angle of 70°.

The refractive index of the non-deoxidized lead glass dynode was 1.49, and the refractive index of the deoxidized lead glass dynode was 1.8+0.15 j, where "j" indicates an imaginary unit. Thus, the deoxidized lead glass dynode has a refractive index greater than that of the non-deoxidized lead glass dynode. It is apparent that the precipitating lead glass increases the refractive index.

It is noted that the refractive index of the ITO film is about 1.5, and therefore is smaller than the refractive index of the deoxidized lead glass dynode. Accordingly, the ITO film formed over the deoxidized lead glass dynode can properly serve as an antireflection layer.

These measurements therefore show that it becomes possible to prevent light from scattering at the electron input surface of the MCP 50 through constructing the dynode 51 from a deoxidized lead glass and forming an ITO film over the electron incident surface of the dynode.

Figure 3:
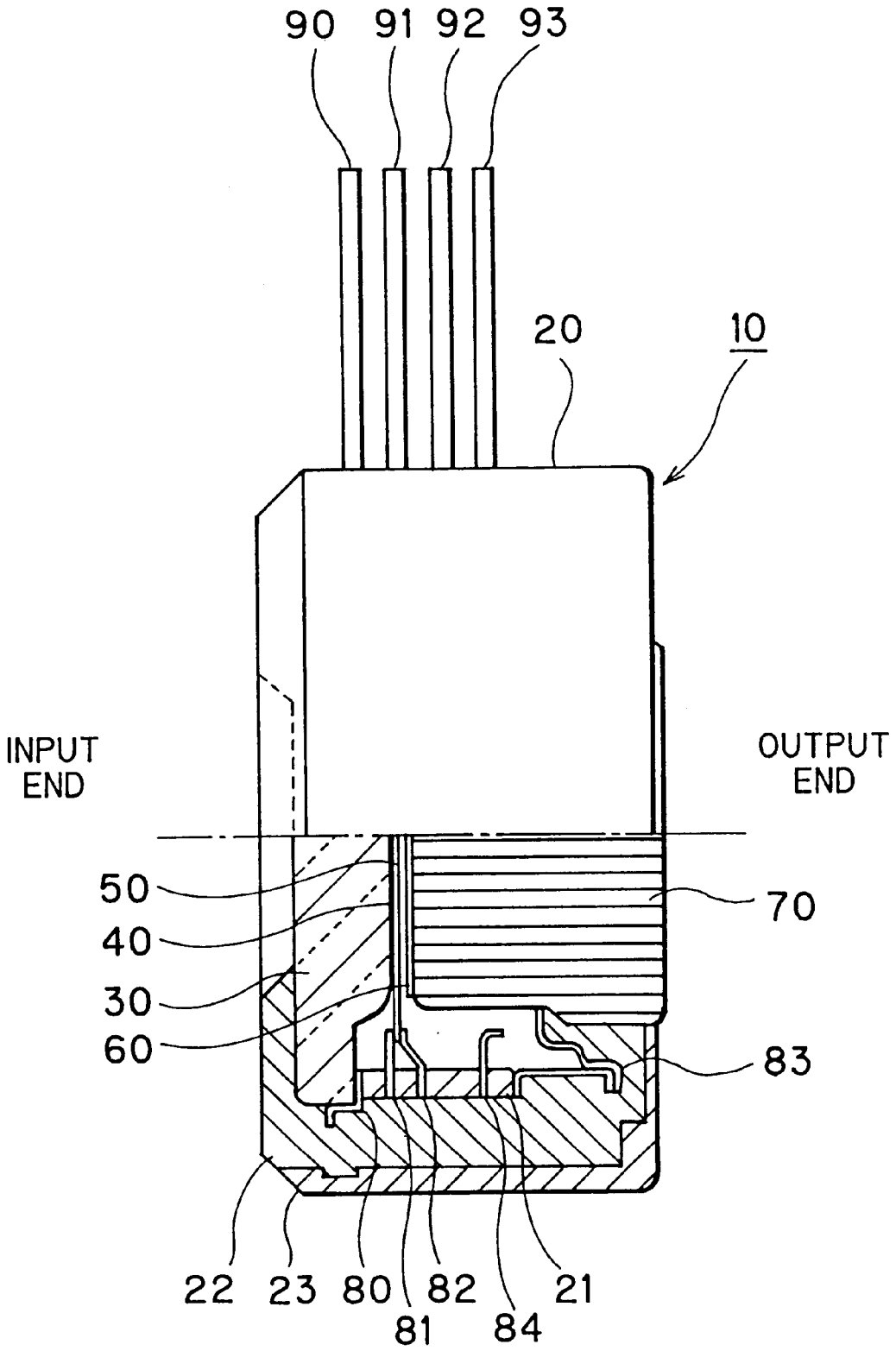
FIG. 3 is a partial sectional view of a photomultiplier tube of a concrete example of an embodiment of the present invention.

The present inventors then produced a photomultiplier tube which had the structure shown in FIG. 3 and which had an ITO film over the electron input surface of the dynode 51. The present inventors produced a comparative photomultiplier tube, in which an Inconel film was provided over the electron input surface of the dynode 51. The comparative photomultiplier tube had the same structure as that shown in FIG. 3 except the Inconel film. The present inventors measured flare presented by those photomultiplier tubes. In this measurement, each photomultiplier tube was driven to pick up a black color rectangular pattern appearing on a white background. The picked up image was optically processed, and a flare value was calculated. The flare value was defined as a ratio, at which the picked up black level of the rectangular pattern increased from the original zero level, where the white background level was set to 100%.

The flare value obtained for the photomultiplier tube with the ITO film was 5%, while the flare value obtained for the photomultiplier tube with the Inconel film was 10%. These results show that the ITO film formed on the electron input surface of the dynode properly prevents light from scattering at the electron input surface of the dynode.

The present inventors then produced two photomultiplier tubes with the Inconel films, denoted by Nos. 1 and 2 in the Table 1 below, and three photomultiplier tubes with the ITO films, denoted by Nos. 3, 4, and 5. The photomultiplier tubes Nos. 3 and 5 have the structure shown in FIG. 3. The photomultiplier tube No. 4 has the same structure as that of FIG. 3 except for the surface condition of the fluorescent screen. The photomultiplier tubes Nos. 1 and 2 have the same structure as that of FIG. 3 except for the surface conditions of the MCP and the fluorescent screen.

TABLE 1

| No. | Diameter of Channel Tube [μm] | Strip Resistance of Micro-channel Plate [MΩ] | Surface Condition of Diode | Surface Condition of Fluorescent Screen |
|---|---|---|---|---|
| 1 | 6 | 70 | Inconel Film Deposited | No Carbon Layer |
| 2 | 6 | 1300 | Inconel Film Deposited | Carbon Layer Deposited |
| 3 | 6 | 175 | ITO Film Deposited | Carbon Layer Deposited |
| 4 | 10 | 2680 | ITO Film Deposited | No Carbon Layer |
| 5 | 6 | 2600 | ITO Film Deposited | Carbon Layer Deposited |

Figure 8:
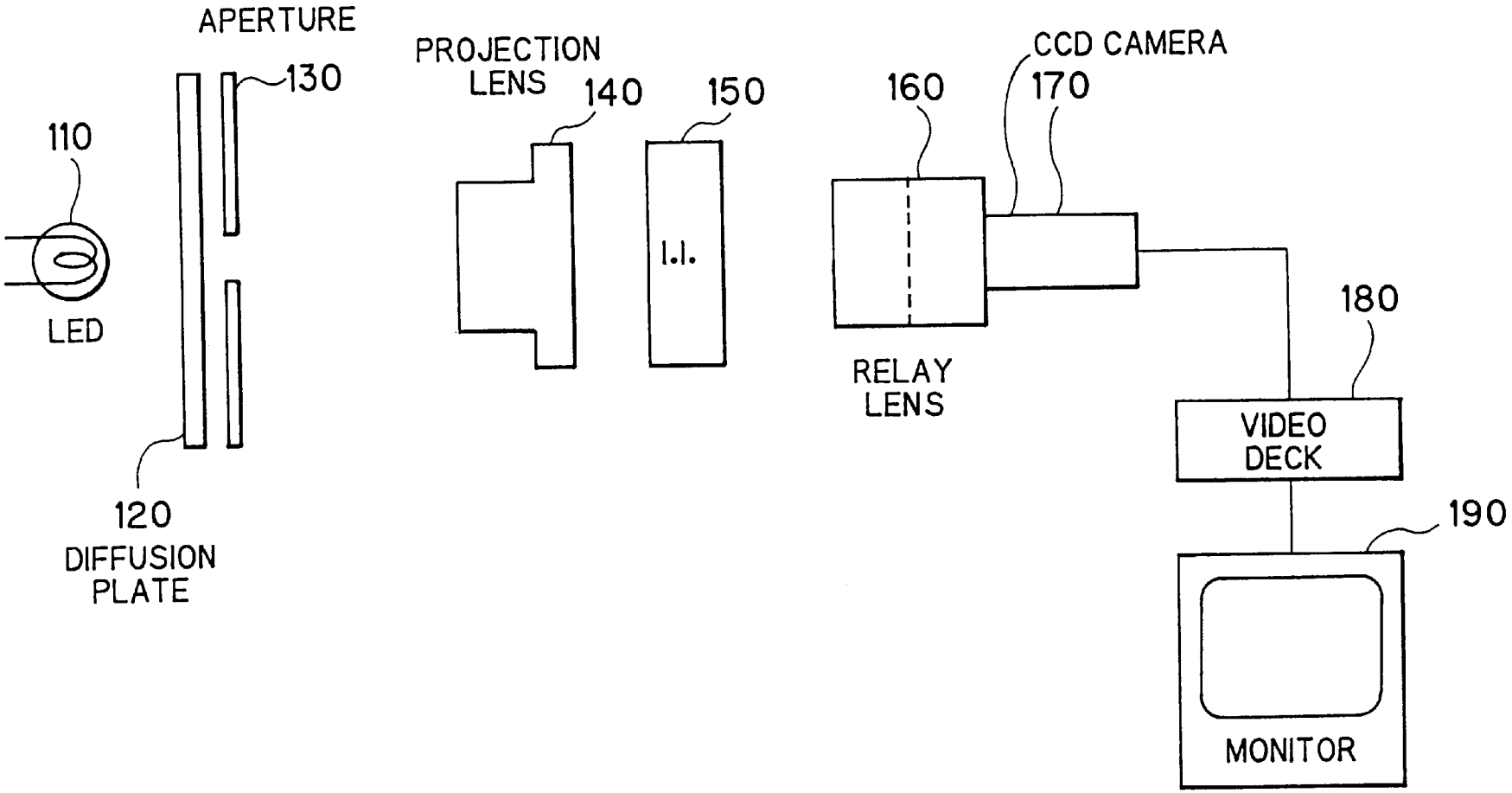
FIG. 8 is a block diagram showing the structure of an image pick up system used in an experiment.

The present inventors measured halo presented by the photomultiplier tubes. In these measurements, the present inventors placed each photomultiplier tube in an pick up system shown in FIG. 8. In the image pick up m, the photomultiplier tube (referred to as "image intensifier 150" in FIG. 8) was controlled to pick up a light spot emitted from a light emitting diode 110. A CCD camera 170 was placed behind the output 70 of the photomultiplier tube 150. The CCD camera 170 was driven to pick up both a light and halo appearing on the fluorescent screen 60 and outputted from the output 70.

In the optical pick up system, a diffusion plate 120, an aperture plate 130, and an objective lens 140 are located between the LED 110 and the image intensifier 150. These optical elements properly guide the light from the LED 110 to the input 30 of the image intensifier 150. A relay lens 160 is placed between the output 70 of the image intensifier 150 and the CCD camera 170. A video output terminal of the CCD camera 170 was connected via a video deck 180 to a monitor television 190.

The LED 110 emitted red light with wavelength of 630 nm. The diffusion plate 120 had luminance of 0.8 lx (lux). The aperture plate 130, formed with an aperture, was separated from the LED 110 by a distance of 3.2 m. The objective lens 140 was produced by Nicon Corporation, and had a focus length of 24 mm and an F number of 2. The image intensifier 150 was driven to intensify the input light at a fixed luminous gain of 10001 $m \cdot m^{-2} \cdot 1 \times^{-1}$. The relay lens 160 was comprised of two lenses which were connected at 1:1. Both of the two lenses had focus lengths of 50 nm and the F numbers of 1.2. The CCD camera 170 was produced by Sony Corporation, and had a view angle of ⅔". The optical system was designed to eliminate halo that will be possibly occurred when light returns from the image intensifier 150 to the objective lens 140.

Figure 9:
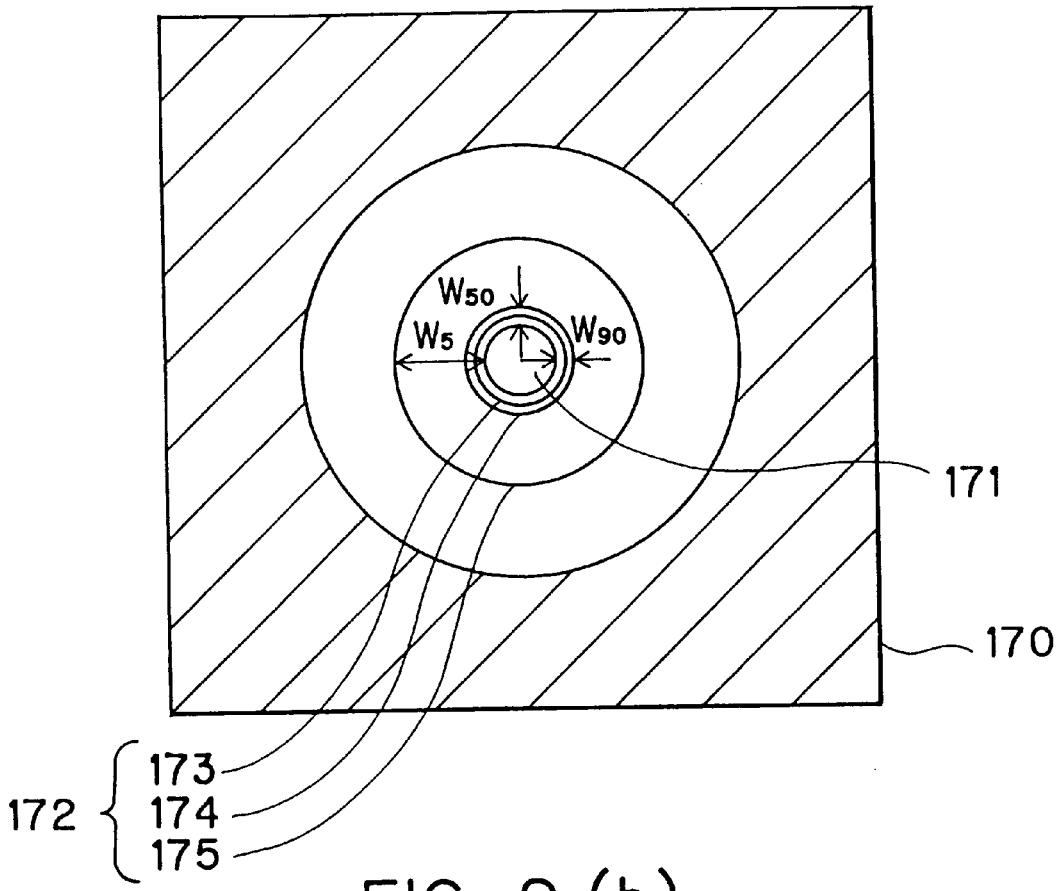
FIG. 9(*a*) is a plan view of a light spot and a halo received on a light receiving surface of a CCD camera employed in the image pick up system of FIG. 8.
Figure 9:
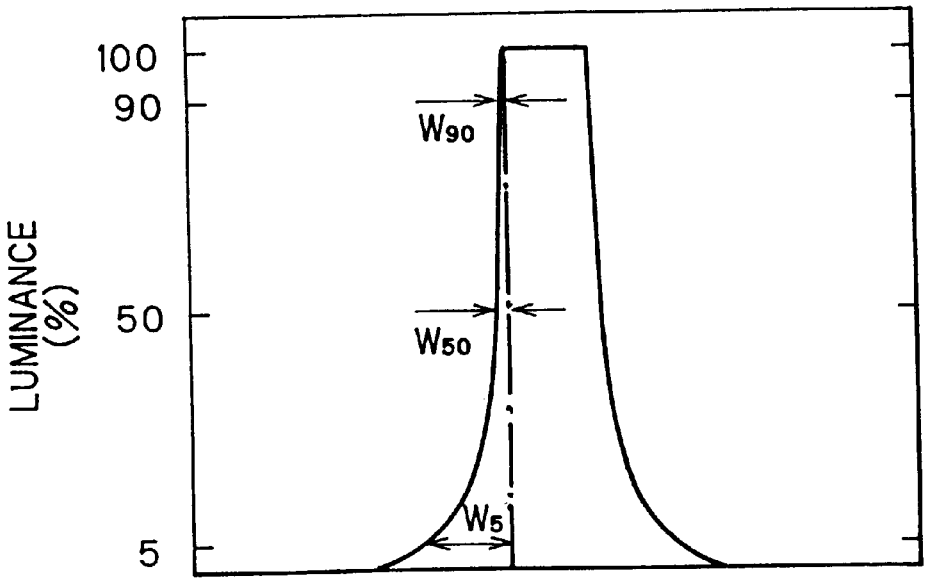

FIG. 9(*a*) show a light spot 171 and a halo light 172 received on a light receiving surface of the CCD 170. The luminance of the light spot 171 had a CCD saturated level. The halo light 172 was divided into three components 173–175 with respective luminances of 90%, 50% and 5% of the CCD saturated level. The halo light components 173–175 and had outer radii of $W_{90}$, $W_{50}$, and $W_5$, respectively.

The CCD 170 was driven to measure luminance distribution on the light receiving surface. FIG. 9(*b*) shows the measured results. In this figure, the radii $W_{90}$, $W_{50}$, and $W_5$ are also indicated. In the measurements, a group of the radii $W_{90}$, $W_{50}$, and $W_5$ obtained for each photomultiplier tube is used as a parameter indicative of the halo phenomenon created by the photomultiplier tube.

Figure 10:
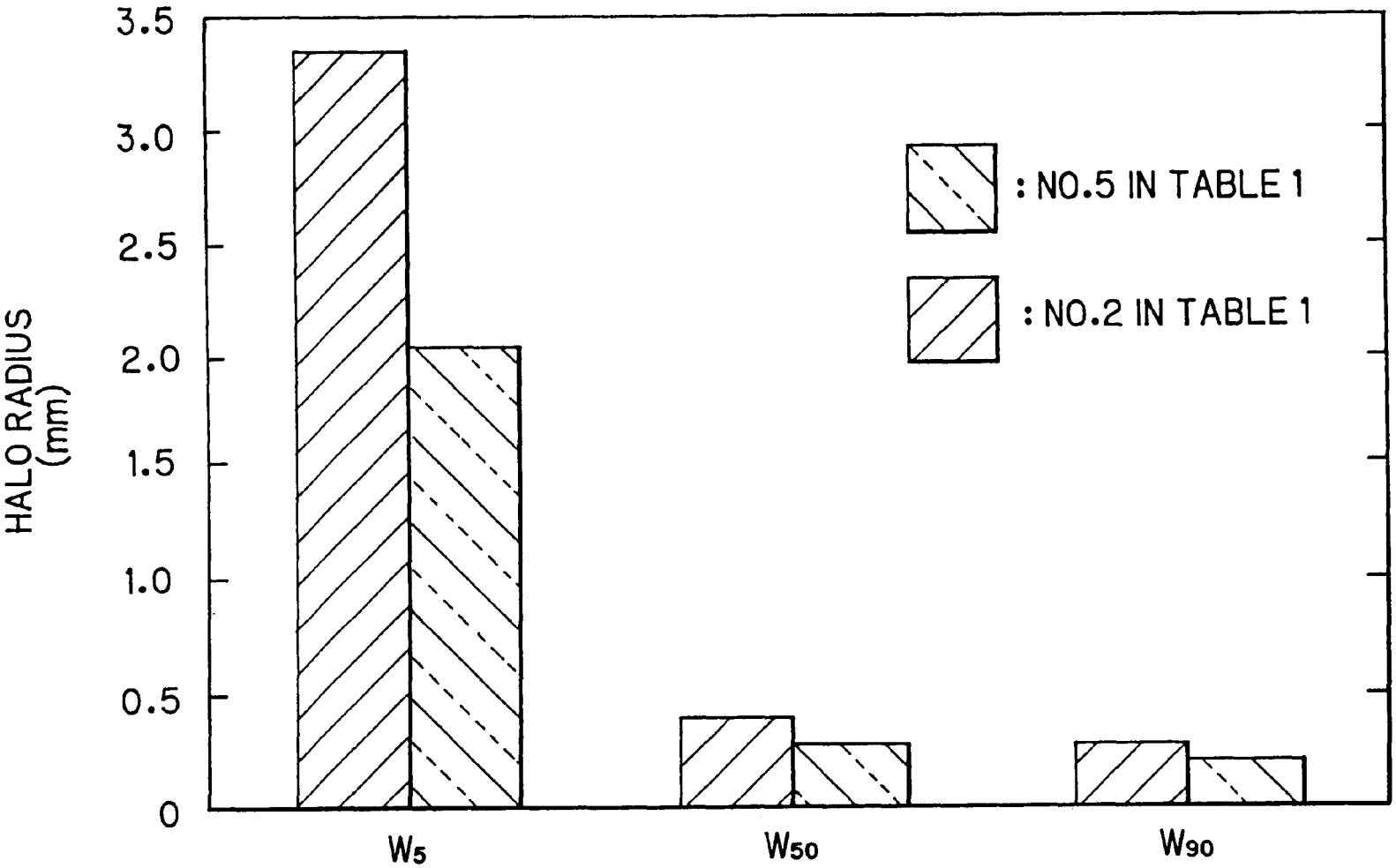
FIG. 10 is a graph showing radii of halo components measured for various photomultiplier tubes.

FIG. 10 shows the amounts of the radii $W_{90}$, $W_{50}$, and $W_5$ of the halo components obtained when the photomultiplier tubes Nos. 5 and 2 in Table 1 were used as the image intensifier 150. This graph shows that the ITO film suppresses halo more than does the Inconel film. Apparently, the ITO film properly prevents light from scattering on the dynode 51. Although not shown in the drawings, the measured results further show that the halo can be more effectively suppressed through depositing carbon on the fluorescent screen and increasing the strip resistance in the MCP.

The above-described measurements show that the Inconel film, which has a high metal gloss, largely reflects and scatters light that passes through the photocathode 40.

The large amount of light returns to the photocathode 40, which, as a result, emits a large amount of photoelectrons at positions where no light enters from outside. This produces halo and flare. Contrarily, the ITO film is transparent and can transmit the light. The deoxidized lead metal dynode is black, has low light reflectivity, and absorbs the entering light. In addition, the ITO film presents a lower refractive index in regards to the light than does the deoxidized lead glass. Accordingly, only a small amount of light scatters on the ITO film and returns to the photocathode 40.

While the invention has been described in detail with reference to specific embodiments thereof, it would be apparent to those skilled in the art that various changes and modifications may be made therein without departing from the spirit of the invention.

For example, the above-described embodiment discloses a proximity image intensifier. However, the photomultiplier tube of the present invention is not limited to the structure of the proximity image intensifier. The present invention can be applied to various types of photomultiplier tubes where a focus electrode is provided between the photocathode and the MCP for controlling photoelectrons. The photomultiplier tube is not limited to a two dimensional detector such as the image intensifier. For example, the fluorescent screen can be omitted from the rear stage of the MCP, but a general type of anode may be provided in confrontation with the output side of the MCP.

The ITO film or the NESA film and the deoxidized lead glass dynode is the preferable combination of the electrode layer 52 and the dynode 51. However, other various transparent conductive materials can be employed as the electrode layer 52. Other various dynode materials can be used as the dynode 51.

As described above, according to the present invention, the transparent conductive film formed over the MCP can suppress reflection and scattering of the incident light. The transparent conductive film can therefore suppress the halo and flare phenomena. It is still possible to suppress the halo and flare phenomena, even when the intervals at which the channels are opened on the dynode are reduced and accordingly the length of channel edges per unit area increases. It is therefore possible to enhance light detectability such as contrast and resolution while suppressing the halo and flare.

What is claimed is:

1. A microchannel plate for multiplying incident electrons, said microchannel plate comprising:

a dynode with an electron incident surface and an electron output surface opposed to the electron incident surface, said dynode being formed with a plurality of channels arranged to extend between said electron incident surface and said electron output surface;

an output side electron layer provided on said electron output surface of said dynode; and and input side electron layer provided directly on said electron incident surface of said dynode only on edges of said dynode separating said channels, said input side electrode layer having an exposed surface, an electric voltage being formed between said output side electron layer and said in side electron layer to generate an electric field in each of said plurality of channels, said input side electrode layer being formed of a conductive material which transmits light incident to said exposed surface of said input side electrode layer;

wherein said dynode comprises a material having a first refractive index with respect to light, and wherein said conductive material of said input side electron layer has a second refractive index lower than said first refractive index.

2. A microchannel plate according to clam 1, wherein said dynode comprises a material which absorbs light having passed through said input side electrode layer.

3. A microchannel plate according to claim 2, wherein said conductive material of said input side electrode layer is transparent, and at least a portion of said dynode is opaque.

4. A microchannel plate according to claim 3, wherein said input side electrode layer is one of an indium-tin-oxide film and a tin oxide film, and said dynode is made of a deoxidized lead glass, a metal lead precipitating at least on said electrode incident surface of the dynode to present black color.

5. A microchannel plate according to claim 1, wherein said input side electrode layer is made of an indium-tin-oxide film.

6. A microchannel plate according to claim 5, wherein said dynode is made of a deoxidized lead glass.

7. A microchannel plate according to claim 1, wherein said input side electrode layer is made of a tin oxide film.

8. A microchannel plate according to claim 7, wherein said dynode is made of deoxidized lead glass.

9. A photomultiplier tube, comprising:

a photocathode for receiving light and for emitting photoelectrons accordingly;

a microchannel plate for receiving said photoelectrons and for multiplying said photoelectrons, said microchannel plate having a dynode with an electron incident surface and an electron output surface opposed to said electron incident surface, said dynode being formed with a plurality of channels arranged to extend between said electron incident surface and said electron output surface, said microchannel plate being located with said electron incident surface confronting said photocathode, an output side electrode layer being provided on said electron output surface of said dynode, and an input side electron layer being provided directly on said electron incident surface of said dynode only on edges of said dynode separating said channels, said input side electrode layer having an exposed surface confronting said photocathode, said input side electrode layer being formed of a conductive material for transmitting light incident to said exposed surface, an electric voltage being applied between said output side electrode layer and said input side electrode layer to generate an electric field in each of said plurality of channels; and an anode located in confrontation with said electron output surface of said microchannel plate for receiving multiplied electrons from said microchannel plate;

wherein said dynode comprises a material having a first refractive index with respect to light, and wherein said conductive material of said input side electrode layer has a second refractive index lower than said first refractive index.

10. A photomultiplier tube according to claim 9, wherein said dynode is made of a material which absorbs the light having passed through said input side electrode layer.

11. A photomultiplier tube according to claim 9, wherein said input side electrode layer provided on said electron incident surface of said microchannel plate is made of an indium-tin-oxide film.

12. A photomultiplier tube according to claim 9, wherein said input side electrode layer provided on said electron incident surface of said microchannel plate is made of a tin oxide film.

13. A photomultiplier tube according to claim 9, wherein said dynode of said microchannel plate is made of a deoxidized lead glass.

14. A photomultiplier tube according to claim 9, further comprising an evacuated envelope enclosing said photocathode, said microchannel plate, and said anode, said envelope having an input for receiving light and for guiding the light to said photocathode.

15. A photomultiplier tube according to claim 14, wherein said photocathode emits photoelectrons upon receiving light of a predetermined wavelength, and wherein said input is made of a glass plate for transmitting light of said predetermined wavelength.

16. An image intensifier apparatus, comprising:

a photocathode for converting a light bearing a first optical image to corresponding photoelectrons;

a microchannel plate for multiplying said photoelectrons, said microchannel plate having a dynode with an electron incident surface and an electron output surface opposed to said electron incident surface, said dynode being formed with a plurality of channels arranged to extend between said electron incident surface and said electron output surface, said microchannel plate being located with said electron incident surface confronting said photocathode, an output side electrode layer being provided on said electron output surface of said dynode, and an input side electrode layer being provided directly on said electron incident surface of said dynode only on edges of said dynode separating said channels, said input side electrode layer having an exposed surface confronting said photocathode, said input side electrode layer being made of conductive material transmits light incident to the exposed surface, an electric voltage being applied between said output side electrode layer and said input side electrode layer to generate an electric field in each of said plurality of channels; and a fluorescent screen for converting said photoelectrons multiplied in said microchannel plate to a light bearing an intensified first optical image, said fluorescent screen emitting said intensified first optical image as a second optical image;

wherein said dynode comprises a material having a first refractive index with respect to light, and wherein said conductive material of said input side electrode layer has a second refractive index lower than said first refractive index.

17. An image intensifier apparatus according to claim 16, wherein said dynode is made of a material which absorbs the light having passed through said input side electrode layer.

18. An image intensifier apparatus according to claim 16, wherein said input side electrode layer provided on said electron incident surface is made of an indium-tin-oxide film.

19. An image intensifier apparatus according to claim 16, wherein said input side electrode layer provided on said electron incident surface is made of a tin oxide film.

20. An image intensifier apparatus according to claim 16, wherein said dynode is made of a deoxidized lead glass.

21. An image intensifier apparatus according to claim 16, further comprising an evacuated envelope enclosing said photocathode, said microchannel plate, and said fluorescent screen, said envelope having an input for receiving the light and for guiding the light to said photocathode, and wherein said photocathode emits photoelectrons upon receiving light of a predetermined wavelength, and wherein said input being made of a glass plate which transmits light of said predetermined wavelength.

22. An image intensifier apparatus according to claim 21, wherein said envelope further comprises an output for emitting said second optical image from said fluorescent screen.

23. An image intensifier apparatus according to claim 22, wherein said fluorescent screen is capable of emitting fluorescent light in response to being struck by multiplied electrons, ad wherein said output is made of a glass plate for transmitting the fluorescent light.

24. An image intensifier apparatus according to claim 22, wherein said fluorescent screen emits fluorescent light in response to being struck by multiplied electrons, and wherein said output is made of a fiber plate comprised of a plurality of optical fibers for guiding the fluorescent light from said fluorescent screen.

25. An image intensifier apparatus according to claim 16, wherein said photocathode, said microchannel plate, and said fluorescent screen are located close to one another, with the distance between said photocathode and said microchannel plate being in a range of 0.05 to 0.3 mm and the distance between said microchannel plate and said fluorescent screen being in a range of 0.2 to 1.5 mm.

26. A microchannel plate for multiplying incident electrons, said microchannel plate comprising:

a dynode with an electron incident surface and an electron output surface opposed to the electron incident surface, said dynode being formed with a plurality of channels arranged to extend between said electron incident surface and said electron output surface;

an output side electrode layer provided on said electron output surface of said dynode; and an input side electrode provided directly on said electron incident surface of said dynode only on edge portions of said dynode separating said channels and partially extending from said edge portions onto side portions of said dynode arranged between adjacent channels, said input side electrode layer having an exposed surface, an electric voltage being applied between said output side electrode layer and said input side electrode layer to generate an electric field in each of said plurality of channels, said input side electrode layer being formed of a conductive material transmitting light incident to said exposed surface of said input side electrode layer;

wherein said dynode is made of a material having a first refractive index with respect to light, and wherein said conductive material of said input side electrode layer has a second refractive index lower than said first refractive index.

27. A photomultiplier tube, comprising:

a photocathode for receiving light and for emitting photoelectrons accordingly;

a microchannel plate for receiving said photoelectrons and for multiplying said photoelectrons, said microchannel plate having a dynode with an electron incident surface and an electron output surface opposed to said electron incident surface, said dynode being formed with a plurality of channels arranged to extend between said electron incident surface and said electron output surface, said microchannel plate being located with said electron incident surface confronting said photocathode, an output side electrode layer being provided on said electron output surface of said dynode, and an input side electrode layer being provided directly on said electron incident surface of said dynode only on edge portions of said dynode separating said channels and partially extending onto side portions of said dynode arranged between adjacent channels, said input side electrode layer having an exposed surface confronting said photocathode, said input side electrode layer being formed of a conductive material transmitting light incident to said exposed surface, an electric voltage being applied between said output side electrode layer and said input side electrode layer to generate an electric field in each of said plurality of channels; and an anode located in confronting with said electron output surface of said microchannel plate for receiving multiplied electrons from said microchannel plate;

wherein said dynode is made of a material having a first refractive index with respect to light, and wherein said conductive material of said input side electrode layer has a second refractive index lower than said first refractive index.

28. An image intensifier apparatus, comprising:

a photocathode for converting a light bearing a first optical image to corresponding photoelectrons;

a microchannel plate for multiplying said photoelectrons, said microchannel plate having a dynode with an electron incident surface and an electron output surface opposed to said electron incident surface, said dynode being formed with a plurality of channels arranged to extend between said electron incident surface and said electron output surface, said microchannel plate being located with said electron incident surface confronting said photocathode, an output side electrode layer being provided on said electron output surface of said dynode, and an input side electrode layer being provided directly on said electron incident surface of said dynode only on edge portions of said dynode separating said channels and partially extending onto side portions of said dynode arranged between adjacent channels, said input side electrode layer having an exposed surface confronting said photocathode, said input side electrode layer being made of conductive material transmitting light incident to the exposed surface, an electric voltage being applied between said output side electrode layer and said input side electrode layer to generate an electric field in each of said plurality of channels; and a fluorescent screen for converting said photoelectrons multiplied in said microchannel plate to a light bearing an intensified first optical image, said fluorescent screen emitting said intensified first optical image as a second optical image;

wherein said dynode is made of a material having a first refractive index with respect to light, and wherein said conductive material of said input side electrode layer has a second refractive index lower than said first refractive index.

29. A microchannel plate for multiplying incident electrons, said microchannel plate comprising:

a dynode with an electron incident surface and an electron output surface opposed to the electron incident surface, said dynode being formed with a plurality of channels arranged to extend between said electron incident surface and said electron output surface, said dynode being made of a material having a first refractive index with respect to light;

an output side electrode layer provided on said electron output surface of said dynode; and an input side electrode layer provided directly on said electron incident surface of said dynode only on edge portions of said dynode separating said channels and partially extending onto side portions of said dynode arranged between adjacent channels, side input side electrode layer having an exposed surface, said input side electrode layer being formed of a conductive material transmitting light incident to said exposed surface of said input side electrode layer and which has a second refractive index lower than said first refractive index.

30. A photomultiplier tube, comprising:

a photocathode for receiving light and for emitting photoelectrons accordingly; a microchannel plate for receiving said photoelectrons and for multiplying said photoelectrons, said microchannel plate having a dynode with an electron incident surface and an electron output surface opposed to said electron incident surface, said dynode being formed with a plurality of channels arranged to extend between said electron incident surface and said electron output surface, said dynode being made of a material having a first refractive index with respect to the light, said microchannel plate being located with said electron incident surface confronting said photocathode, an output side electrode layer being provided on said electron output surface of said dynode, and an input side electrode layer being provided directly on said electron incident surface of said dynode only on edge portions of said dynode separating said channels and partially extending onto side portions of said dynode arranged between adjacent channels, said input side electrode layer having an exposed surface confronting said photocathode, said input side electrode layer being formed of a conductive material transmitting light incident to said exposed surface and which has a second refractive index lower than said first refractive index; and an anode located in confrontation with said electron output surface of said microchannel plate for receiving multiplied electrons from sid microchannel plate.

31. An image intensifier apparatus, comprising:

a photocathode for converting a light bearing a first optical image to corresponding photoelectrons;

a microchannel plate for multiplying said photoelectrons, said microchannel plate having a dynode with an electron incident surface and an electron surface opposed to said electron incident surface, said dynode being formed with a plurality of channels arranged to extend between said electron incident surface and said electron output surface, said dynode being made of a material having a first refractive index with respect to the light, said microchannel plate being located with said electron incident surface confronting said photocathode, an output side electrode layer being provided on said electron output surface of said dynode, and an input side electrode layer being provided directly on said electron incident surface of said dynode only on edge portions of said dynode separating said channels and partially extending onto side portions of said dynode arranged between adjacent channels, said input side electrode layer having an exposed surface confronting said photocathode, said input side electrode layer being formed of a conductive material transmitting light incident to said exposed surface and which has a second refractive index lower than the first refractive index; and a fluorescent screen for converting said photoelectrons multiplied in said microchannel plate to a light being an intensified first optical image, said fluorescent screen emitting said intensified first optical image as a second optical image.

32. A microchannel plate for multiplying incident electrons, said microchannel plate comprising:

a dynode with an electron incident surface and an electron output surface opposed to the electron incident surface, said dynode being formed with a plurality of channels arranged to extend between said electron incident surface and said electron output surface;

an output side electrode layer provided on said electron output surface of said dynode; and an input side electrode layer provided directly on said electron incident surface of said dynode and being formed with a plurality of apertures in correspondence with said plurality of channels of said dynode, said input side electrode layer having an exposed surface, said input side electrode layer being formed of a conductive material transmitting light incident to said exposed surface of said input side electrode layer;

wherein said dynode is made of a material having a first refractive index with respect to light, and wherein said conductive material of said input side electrode layer has a second refractive index lower than said first refractive index.

33. A microchannel plate as claimed in claim 32, wherein said input side electrode layer includes a portion extending from said electron incident surface of said dynode onto a part of said portion of said dynode arranged between adjacent channels.

34. A photomultiplier tube, comprising:

a photocathode for receiving light and for emitting photoelectrons accordingly;

a microchannel plate for receiving said photoelectrons and for multiplying said photoelectrons, said microchannel plate having a dynode with an electron incident surface and an electron output surface opposed to said electron incident, said dynode being formed with a plurality of channels ranged to extend between said electron incident surface and said electron output surface, said dynode being made of a material having a first refractive index with respect to light, said microchannel plate being located with said electron incident surface confronting said photocathode, an output side electrode layer being provided on said electron output surface of said dynode, and an input side electrode layer being provided directly on said electron incident surface of said dynode and being formed with a plurality of apertures in correspondence with said plurality of channels of said dynode, said input side electrode layer having an exposed surface confronting said photocathode, said input side electrode layer being formed of conductive material transmitting light incident on said exposed surface and which has a second refractive index lower than said first refractive index; and anode located in confrontation with said electron output surface of said microchannel plate or receiving multiplied photoelectrons from said microchannel plate.

35. A photomultiplier tube as claimed in claim 34, wherein said input side electrode layer includes a portion extending from said electron incident surface of said dynode onto a part of side portion of said dynode arranged between adjacent channels.

36. An image intensifier apparatus, comprising:

a photocathode for converting a light bearing a first optical image to corresponding photoelectrons;

a microchannel plate for multiplying said photoelectrons, said microchannel plate having a dynode with an electron incident surface and an electron output surface opposed to said electron incident surface, said dynode being formed with a plurality of channels arranged to extend between said electron incident surface and said electron output surface, said microchannel plate being located with said electron incident surface confronting said photocathode, an output side electrode layer being provided on said electron output surface of said dynode, and an input side electrode layer being provided directly on said electron incident surface of said dynode and being formed with a plurality of apertures in correspondence with said plurality of channels of said dynode, said input side electrode layer having an exposed surface confronting said photocathode, said input side electrode layer being made of conductive material transmitting light incident to the exposed surface; and a fluorescent screen for converting said photoelectrons multiplied in said microchannel plate to a light being an intensified first optical image, said fluorescent screen emitting said intensified first optical image as a second optical image;

wherein said dynode is made of a material having first refractive index with respect to light, and wherein said conductive material of said input side electrode layer has a second refractive index lower than said first refractive index.

37. A image intensifier apparatus as claimed in claim 36, wherein said input side electrode layer includes a portion extending from said electron incident surface of said dynode onto a part of side portions of said dynode arranged between adjacent channels.

38. A microchannel plate as claimed in claim 1, wherein said input side electrode layer partially extends from said edge portions onto side portions of said dynode arranged between adjacent channels.

39. A photomultiplier tube as claimed in claim 9, wherein said input side electrode layer partially extends from said edge portions onto side portions of said dynode arranged between adjacent channels.

40. An image intensifier apparatus as claimed in claim 16, wherein said input side electrode layer partially extends from said edge portions onto side portions of said dynode arranged between adjacent channels.

* * * * *